US006994369B2

(12) United States Patent
Restani

(10) Patent No.: US 6,994,369 B2
(45) Date of Patent: Feb. 7, 2006

(54) GLIDING BOARD AND METHOD FOR MANUFACTURE OF SUCH A GLIDING BOARD

(75) Inventor: Eric Restani, Voiron (FR)

(73) Assignee: Skis Rossignol S.A., Voiron (FR)

( * ) Notice: Subject to any disclaimer, the term of this patent is extended or adjusted under 35 U.S.C. 154(b) by 153 days.

(21) Appl. No.: 10/701,203

(22) Filed: Nov. 4, 2003

(65) Prior Publication Data

US 2004/0100068 A1 May 27, 2004

(30) Foreign Application Priority Data

Nov. 22, 2002 (FR) ..... 02 14673

(51) Int. Cl.
*A63C 5/00* (2006.01)

(52) U.S. Cl. ..... 280/610; 280/602

(58) Field of Classification Search ..... 280/608–610, 280/14.21, 14.22; 264/259–261, 46.5, 46.6
See application file for complete search history.

(56) References Cited

U.S. PATENT DOCUMENTS 4,993,740 A * 2/1991 Recher et al. ..... 280/610
5,173,226 A * 12/1992 Cazaillon et al. ..... 264/46.6
5,183,618 A * 2/1993 Pascal et al. ..... 264/257
5,186,777 A * 2/1993 Perenon et al. ..... 156/79
5,496,053 A 3/1996 Abondance
5,690,349 A * 11/1997 Rohrmoser ..... 280/610
5,695,209 A * 12/1997 Deborde et al. ..... 280/610
6,059,308 A * 5/2000 Baudin et al. ..... 280/610

FOREIGN PATENT DOCUMENTS

| | | | |
|---|---|---|---|
| EP | 0558009 | * | 9/1993 |
| FR | 2 069 824 A | | 9/1971 |
| FR | 2 312 273 A | | 12/1976 |
| FR | 2579477 | * | 10/1986 |
| FR | 2 818 915 A | | 7/2002 |
| JP | 6-154385 | * | 6/1994 |
| WO | WO 2004/078286 | * | 9/2004 |

* cited by examiner

*Primary Examiner*—Bryan Fischmann
(74) *Attorney, Agent, or Firm*—Burr & Brown

(57) ABSTRACT

A gliding board, including: an injected polyurethane foam core; lateral reinforcing elements, which form some or all of the edges of the board; at least one internal reinforcement, which is in the form of a solid layer; and two outer layers, of which the lower layer forms the gliding surface and the upper layer forms the protective layer. The internal reinforcement rests on recesses which are provided for this purpose in each of the lateral reinforcing elements. The internal reinforcement has notches on its side profiles so that, level with the notches, the injected core passes through it in order to at least partially occupy the volume defined between the internal reinforcement and at least one of the two outer layers.

11 Claims, 2 Drawing Sheets

GLIDING BOARD AND METHOD FOR MANUFACTURE OF SUCH A GLIDING BOARD

FIELD OF THE INVENTION

The invention concerns the field of snow gliding sports. More particularly, it relates to a novel structure for a gliding board, i.e. for an alpine ski or derivatives such as a nordic ski, as well as for snowboards. It relates more particularly to a novel board structure and to an associated manufacturing method, which make it possible to produce injected-core boards whose upper face has pronounced relief effects and whose internal structure includes rigid reinforcements.

BACKGROUND OF THE INVENTION

In general, gliding boards have a core which is made either as a prefabricated element or by using injection and molding operations, during which chemical components are introduced into a mold and react so as to expand in order to form the core in situ. More precisely, this expansion takes place in the volume defined between two outer layers, an upper one and a lower one, which respectively form the protective upper layer of the board and the gliding surface, as well as lateral reinforcing elements that form some or all of the edges. During the injection, and the expansion which follows, these various elements are pressed against the cavity and the lid of the mold.

In general, the mechanical properties of injection-molded skis are directly linked with the use of internal reinforcements, which generally have a high rigidity. This type of reinforcement is generally made either of metal or based on fiber materials, and especially using laminates that may be based on glass fibers. The choice of the materials, as well as the dimensions of the reinforcement and the way it is positioned inside the core, are crucial for obtaining the desired mechanical characteristics.

As the core expands, it pushes outward all the elements contained in the volume that it fills. All the substantially flat reinforcements known to date are generally arranged either in contact with the layer that forms the gliding surface or the protective upper layer, optionally with the interposition of other specific reinforcements. In order to ensure that the reinforcement is positioned correctly during the injection operation, it is generally adhesively bonded beforehand onto the outer layer with which it comes in contact, which prevents this reinforcement from being displaced when the polyurethane foam moves.

A problem arises with gliding boards whose upper face is not strictly flat, but instead includes recesses or other protuberances. This is because, in this case, it is not possible for the rigid reinforcement to deform in order to adopt the outer shape of the board. A solution to this problem has been proposed by the Applicant in document FR 2 818 915. This solution consists in making openings inside the rigid reinforcement, in order to allow the protective upper layer to be deformed according to the desired volume but without excessively deforming the reinforcement itself. These openings may be complete openings, hence making it easy for the polyurethane foam to pass through. These openings may also be partial openings, so as to allow local deformation of the reinforcement which remains adhesively bonded under the protective upper layer.

These solutions have some drawbacks, however, since it is difficult to accurately limit the passage of the foam that constitutes the core. This sealing problem compromises the precision with which the shapes can be reproduced. Moreover, these solutions require the reinforcement to be located immediately below the protective upper layer. It may prove beneficial to position the reinforcement at an intermediate height, however, rather than directly below the protective upper layer or directly above the gliding surface.

Another solution that makes it possible to distance the reinforcement from the outer layers, which is proposed by document FR 2 312 273, involves perforating the rigid reinforcement over its entire surface in order to let the foam pass fully through. This solution has the drawback that making openings in the reinforcement inevitably causes an at least local reduction in the stiffness of the reinforcement. In the case of fiber reinforcements, the cutouts made in the reinforcement hence destroy the continuity of certain fibers, and therefore reduce the overall strength of the reinforcement.

It is an object of the invention to be able to use reinforcements whose height is optimized in order to provide the board with a specific stiffness. It is also an object to let the reinforcement retain its intrinsic properties, so as to influence the stiffness of the board in the desired way.

SUMMARY OF THE INVENTION

The invention therefore relates to a gliding board which, in the known way, includes:

- an injected polyurethane foam core;
- lateral reinforcing elements, which form some or all of the edges of the board;
- at least one internal reinforcement, which is in the form of a solid layer;
- two outer layers, namely a lower one that forms the gliding surface and an upper one that forms the protective layer of the board.

According to the invention, this board is one wherein the internal reinforcement rests on recesses which are provided for this purpose in each of the lateral reinforcing elements. This internal reinforcement also has notches on its side profiles so that, level with said notches, the injected core passes through it in order to at least partially occupy the volume defined between the internal reinforcement and at least one of the outer layers.

In other words, the characteristic reinforcement extends over the entire width of the board, except for the notched zones that establish communication between the volumes defined above and below the reinforcement so as to allow the foam to circulate as it expands during the formation of the core.

It is therefore possible to arrange the reinforcement at a precise height, which is calculated as a function of the mechanical characteristics required by the board.

Furthermore, by allowing the polyurethane foam to spread out, in particular above the reinforcement by passing through its peripheral parts, it is possible to provide the upper shape of the board with a configuration that is not flat, with great freedom in terms of the various volumes, protuberances and other recesses which it may be desirable to produce. The characteristic reinforcement is not deformed by the presence of these various additional volumes, and therefore retains all of its mechanical characteristics.

It is thus possible to arrange the reinforcement either in the upper part or in the lower part of the core. When the point of injection lies below the reinforcement, this foam hence spreads out by passing above the reinforcement and fills the volume lying below the protective upper layer. When the point of injection lies above the reinforcement, conversely, the polyurethane foam spreads out and expands by passing below the reinforcement and by coming in contact with the gliding surface.

Advantageously, the notches made in the reinforcement may in practice be longitudinally offset from one side of the reinforcement to the other, so that the latter retains a sufficient minimum width in order to maintain an intended rigidity. The reinforcement is thus held on either one side or the other over its entire length, which prevents it from being deformed upward or downward.

In practice, the internal reinforcement may interact with the lateral reinforcing elements at various levels.

For instance, the reinforcement may rest on a recess forming a shoulder made either in the upper part or in the lower part of the lateral reinforcing element, or alternatively in a groove-shaped recess made at an intermediate level on the inner face of the lateral element.

In the case in which the reinforcement rests in a recess on an upper part of the lateral reinforcing element, it may experience contact with the protective upper layer from above.

In practice, the internal reinforcement may vary widely in nature, and may in particular be based on a laminated fiber material or alternatively a metallic material.

As mentioned above, the invention also relates to a method for manufacture by injection or molding of a gliding board that conventionally includes lateral reinforcing elements, which form some or all of the edges of the board, outer layers forming the gliding surface and the protective upper layer, as well as at least one internal reinforcement. The method involves a step of in-situ injecting components that chemically react to produce a foam which expands with a view to forming the core of the board. The method according to the invention is one wherein the internal reinforcement is immobilized in recesses, made for this purpose in the lateral reinforcing elements, when the various constituent elements of the board are being fitted in the mold.

This internal reinforcement has lateral notches that establish communication between the volumes defined above and below the reinforcement so as to allow the foam to circulate as it expands during the formation of the core.

BRIEF DESCRIPTION OF THE DRAWINGS

The way in which the invention is embodied, and the advantages that result therefrom, will become readily apparent from the following description of the embodiment, supported by the appended figures in which.

DETAILED DESCRIPTION OF THE INVENTION

Figure 1:
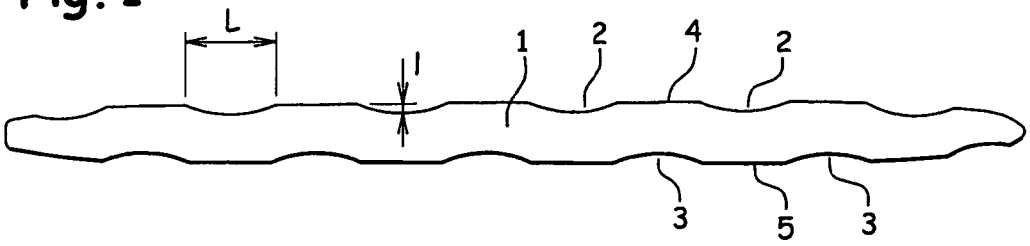
FIG. 1 is a top view of an internal reinforcement according to the invention.

As already mentioned, the invention is based on the integration of a characteristic reinforcement inside a gliding board, FIG. 1 constituting an example of the geometry of this reinforcement.

Such a reinforcement has a width substantially equal to that of the board, and a length which corresponds to the length over which it is intended to extend along the ski.

This reinforcement (1) has multiple notches (2, 3) which are distributed on each of the sides of the reinforcement and are separated by straight portions (4, 5). In practice, these notches (2, 3) have a length L of the order of from 15 to 60 mm, and a length l of the order of a few millimeters, typically from 2 to 6 mm in width.

In the form which is illustrated, the notches (2, 3) are arranged on either side of the reinforcement and are offset with respect to one another so that the width of the reinforcement is reduced only by the width of a single notch.

Figure 3:
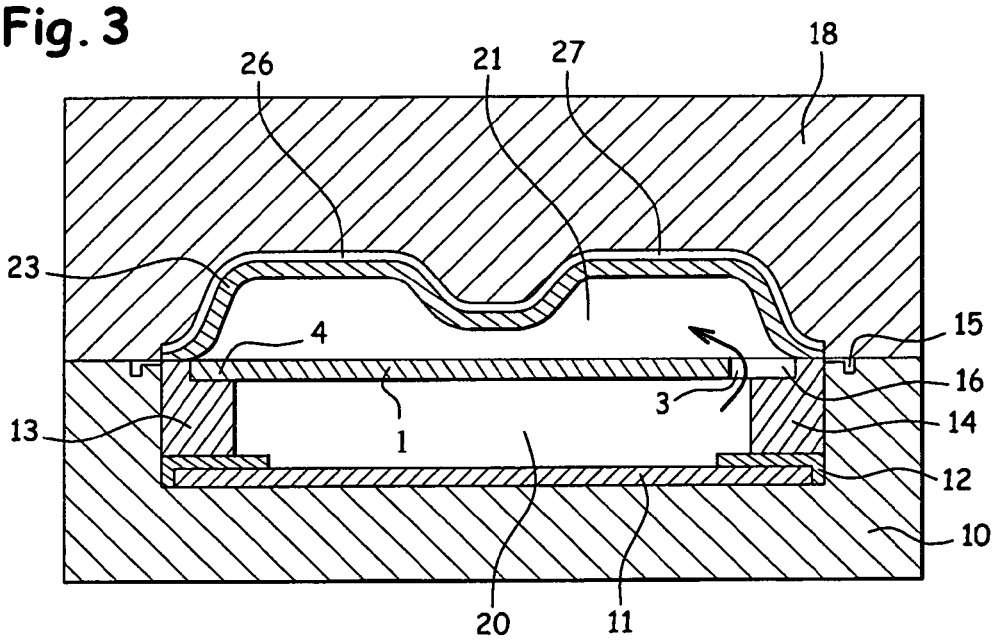
FIG. 3 is a view in cross section of the ski illustrated in FIG. 2, just before the injection operation.
Figure 2:
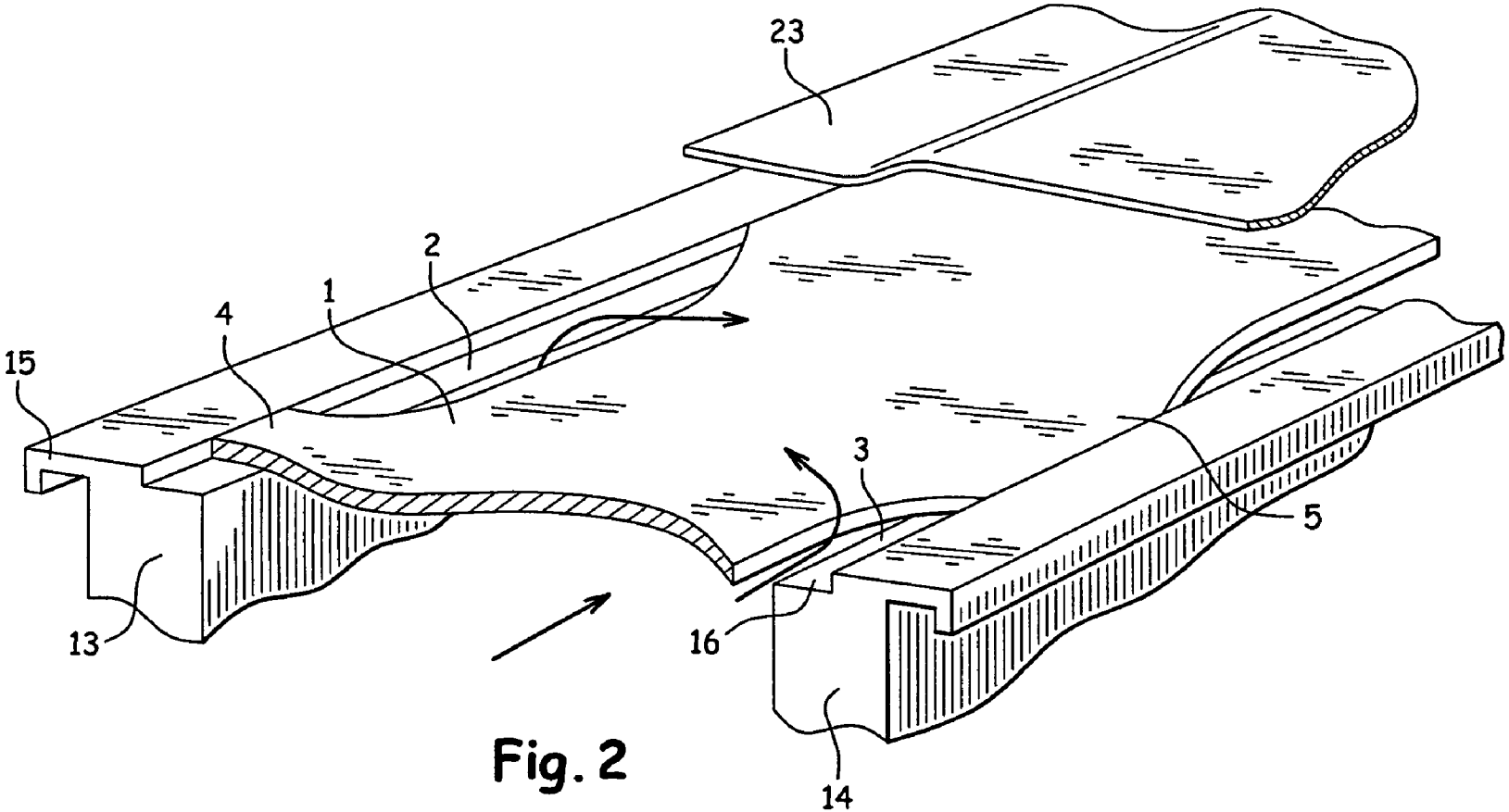
FIG. 2 is a summary perspective view illustrating the way in which some of the constituent elements of a ski are fitted in the manufacturing mold.

The reinforcement is installed as illustrated in FIGS. 2 and 3. Hence, the various elements constituting the lower assembly of the board, namely the gliding surface (11) as well as the edges (12), are placed in a mold base (10). Various reinforcements may be installed directly above the gliding surface, without interfering with the present invention.

The reinforcing elements (13, 14) are subsequently placed above the edges (12), at the border of the compartment of the mold (10). In the form which is illustrated, these reinforcing elements also have fins (15) allowing them to be locked in position in the mold.

Characteristically, these reinforcing elements have a recess made level with their upper inner corner. This recess (16) forms a shoulder on which the straight portions (4, 5) of the reinforcement (1) can rest.

The notches (2,3) of the reinforcement (1) define a passage between the volume (20) lying below the reinforcement (1) and the volume (21) lying above.

This upper volume is bounded by a protective upper layer (23). It can be seen that the lid of the mold (18) has recesses making it possible to define the protuberances (26, 27) on the board. When the various constituents that react to form the polyurethane foam are injected, they spread out by propagating through the volume (20) lying below the reinforcement (1) and by passing through the various notches (2, 3) into the upper volume (21), so as to press the protective layer (23) against the bottom of the lid of the mold. The reinforcement (1) is held in position by virtue of the fact that it experiences contact with the protective upper layer at the level of the reinforcing elements (13, 14).

Figure 4:
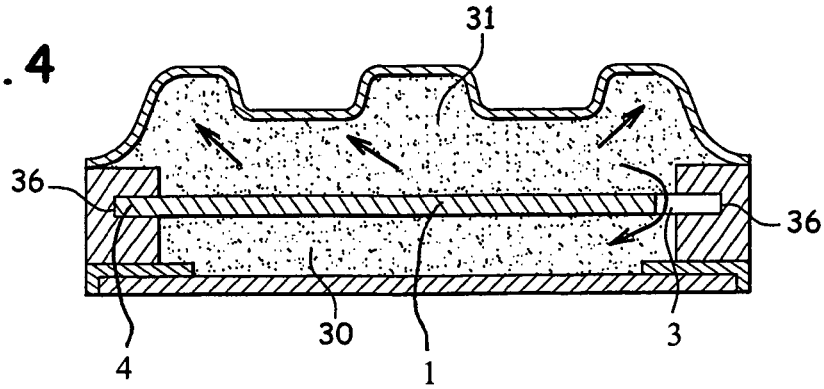
FIG. 4 is a view in cross section of a ski produced according to an alternative embodiment.

According to an alternative embodiment which is illustrated in FIG. 4, the reinforcement (1) is positioned at an intermediate level of the height of the board. In order to do this, it is installed inside grooves (36) in which the straight portions (4, 5) can be integrated. In this case, when the injection is carried out either above or below the reinforcement (1), the notches (2,3) of the reinforcement (1) define passages that permit communication between the lower and upper volumes (30, 31), and therefore uniform distribution of the polyurethane foam.

It can be seen from the explanation above that the boards according to the invention offer the advantage of having reinforcements which are positioned optimally at the height necessary in order to provide the desired rigidity. The presence of these reinforcements nevertheless allows the polyurethane foam to pass through, which makes it possible to produce widely varied volumes and shapes level with the upper face of the board, without degrading the mechanical performance of the reinforcement.

What is claimed is:

1. A gliding board, comprising:

an injected polyurethane foam core;

lateral reinforcing elements forming a plurality of edges of the board;

at least one internal reinforcement, which is a solid layer;

a lower outer layer forming a gliding surface; and an upper outer layer forming a protective upper layer, wherein the internal reinforcement rests on recesses which are provided in each of the lateral reinforcing elements, the internal reinforcement having notches on side profiles thereof so that the injected core passes through the notches in order to at least partially occupy at least one of a volume defined between the internal reinforcement and the upper outer layer and a volume defined between the internal reinforcement and the lower outer layer.

2. The gliding board as claimed in claim 1, wherein the core at least partially occupies the volume defined between the internal reinforcement and the protective upper layer.

3. The gliding board as claimed in claim 1, wherein the core at least partially occupies the volume defined between the internal reinforcement and the lower layer that forms the gliding surface.

4. The gliding board as claimed in claim 1, wherein the notches made in the internal reinforcement are longitudinally offset from one side of said reinforcement to the other.

5. The gliding board as claimed in claim 1, wherein the internal reinforcement rests on a recess that forms a shoulder made in the upper part of each of the lateral reinforcing elements.

6. The gliding board as claimed in claim 1, wherein the internal reinforcement is retained by a recess that forms a shoulder made in the lower part of each of the lateral reinforcing elements.

7. The gliding board as claimed in claim 1, wherein the internal reinforcement rests in a groove-shaped recess made on the inner face of each of the reinforcing lateral elements.

8. The gliding board as claimed in claim 5, wherein the protective upper layer rests at least partly on the internal reinforcement adjacent to the lateral reinforcing elements.

9. The gliding board as claimed in claim 1, wherein the internal reinforcement comprises a laminated fiber material.

10. The gliding board as claimed in claim 1, wherein the internal reinforcement comprises a metallic material.

11. A method for manufacture by injection/molding of a gliding board that includes lateral reinforcing elements forming a plurality of edges of the board, outer layers and at least one internal reinforcement, said method comprising a step of in-situ injecting components that chemically react to produce a foam, which expands to form the core of the board, wherein the internal reinforcement is retained in recesses, made in the lateral reinforcing elements, when the various constituent elements of the board are being fitted in the mold, the internal reinforcement having lateral notches that establish communication between the volumes defined above and below the reinforcement so as to allow the foam to circulate as it expands during the formation of the core.

* * * * *